US009624026B1

(12) United States Patent
Al-Heraibi

(10) Patent No.: US 9,624,026 B1
(45) Date of Patent: Apr. 18, 2017

(54) REMOVABLE DISPENSING COVER FOR TISSUE BOX

(71) Applicant: Abdulrahman Saleh Al-Heraibi, Safat (KW)

(72) Inventor: Abdulrahman Saleh Al-Heraibi, Safat (KW)

( * ) Notice: Subject to any disclaimer, the term of this patent is extended or adjusted under 35 U.S.C. 154(b) by 23 days.

(21) Appl. No.: 15/003,746

(22) Filed: Jan. 21, 2016

(51) Int. Cl.
*B65D 83/08* (2006.01)
*B65D 43/02* (2006.01)

(52) U.S. Cl.
CPC ..... *B65D 83/0805* (2013.01); *B65D 43/02* (2013.01); *B65D 2543/00833* (2013.01)

(58) Field of Classification Search
USPC ..... 221/50
See application file for complete search history.

(56) References Cited

U.S. PATENT DOCUMENTS 1,952,382 A 3/1934 MacGregor
4,574,952 A * 3/1986 Masui ..... B65D 83/0835 206/460
4,782,967 A 11/1988 Thomas
5,372,386 A * 12/1994 Mills ..... B42D 15/0053 235/385
7,651,290 B2 1/2010 Bauer et al.
8,186,541 B2 5/2012 Szymonski et al.
2003/0178336 A1 9/2003 Zomorodi et al.
2007/0131703 A1* 6/2007 Szymonski ..... B65B 25/141 221/50
2013/0199557 A1 8/2013 Maertz
2014/0084112 A1* 3/2014 Stubbe ..... A01K 91/06 244/155 R

FOREIGN PATENT DOCUMENTS

GB 1353314 5/1974

* cited by examiner

*Primary Examiner* — J. Gregory Pickett
*Assistant Examiner* — Allan Stevens
(74) *Attorney, Agent, or Firm* — Richard C. Litman

(57) ABSTRACT

The removable dispensing cover for tissue boxes includes an oblong dispensing cover detachably mounted to a top of a tissue box. A pull tab extends from one end of the dispensing cover for selective grasping by a user for subsequent removal of the dispensing cover from the tissue box to access the tissues. An elongate dispensing thread has a portion thereof attached to the bottom of the dispensing cover, and a dispensing strip is attached to the remaining portion of the dispensing thread. The dispensing strip is attached a top tissue sheet contained in the tissue box, so that as the dispensing cover is removed from the top of the tissue box, the top tissue is also pulled along, ready for use.

8 Claims, 4 Drawing Sheets

REMOVABLE DISPENSING COVER FOR TISSUE BOX

BACKGROUND OF THE INVENTION

1. Field of the Invention

The present invention relates to dispensers, and particularly to a removable dispensing cover for a tissue box enabling a user to easily and automatically draw out a tissue sheet concurrently with the process of opening a fresh box of paper tissues for immediate use.

2. Description of the Related Art

Tissue boxes are used in many homes and offices. These are convenient toiletry items that have many uses besides covering or wiping one's mouth, nose, or face, such as a replacement for napkins, or for wiping dirt and wastes from surfaces. The most prevalent use, however, arises in times of sickness or allergies, when one has to cope with runny nasal passages and expectoration from coughs and sneezes. Unfortunately, the act of an ill person opening a fresh box of tissues may give rise to potential transmission of harmful germs. Most conventional tissue boxes have a removable cover over a slit plastic sheet from which the user must insert their fingers through to draw out initial sheet(s) of tissue in the box. Unless the user's hand has been sanitized, the chances of contamination are rather high. Moreover, some users may not be sufficiently dexterous in removing the cover.

In light of the above, it would be a benefit in the art of dispensers to provide a means of opening a fresh box of tissues with ease and relatively minimal contact with at least the initial sheet therein. Thus, a removable dispensing cover for tissue box solving the aforementioned problems is desired.

SUMMARY OF THE INVENTION

The removable dispensing cover for tissue boxes includes an oblong dispensing cover adapted for detachable mounting to a top of a tissue box. A pull tab extends from one end of the dispensing cover for selective grasping by a user for subsequent removal of the dispensing cover from the tissue box in order to provide access to the tissues in the box. An elongate dispensing thread has a portion thereof attached to the bottom of the dispensing cover, and a dispensing strip is attached to the remaining portion of the dispensing thread. The dispensing strip is attached to a top tissue sheet contained in the tissue box, so that as the dispensing cover is removed from the top of the tissue box, the top tissue is also pulled along for ready use.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
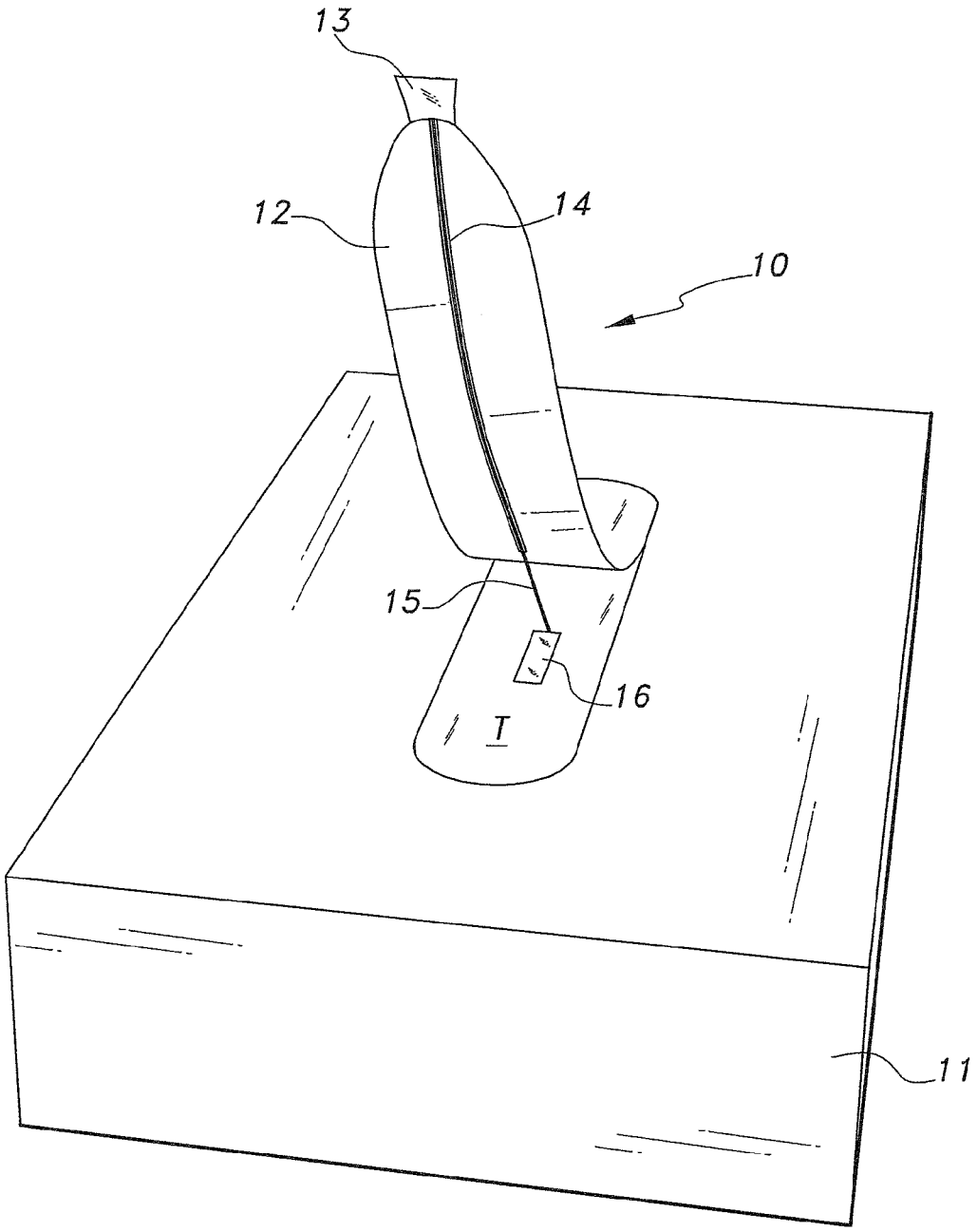
FIG. 1 is an environmental, perspective view of a removable dispensing cover for a tissue box according to the present invention.
Figure 2:
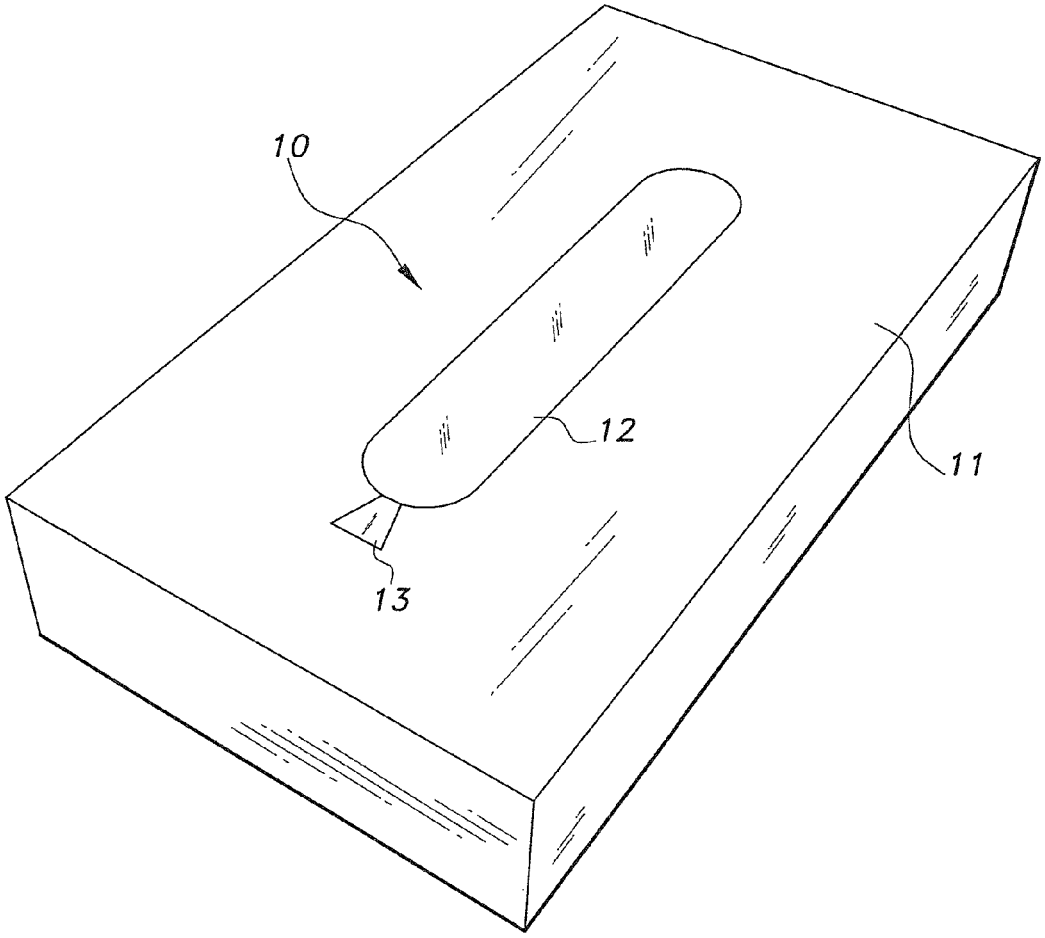
FIG. 2 is an environmental perspective view of the removable dispensing cover of FIG. 1, the removable cover being shown in a covered position on a tissue box.
Figure 3:
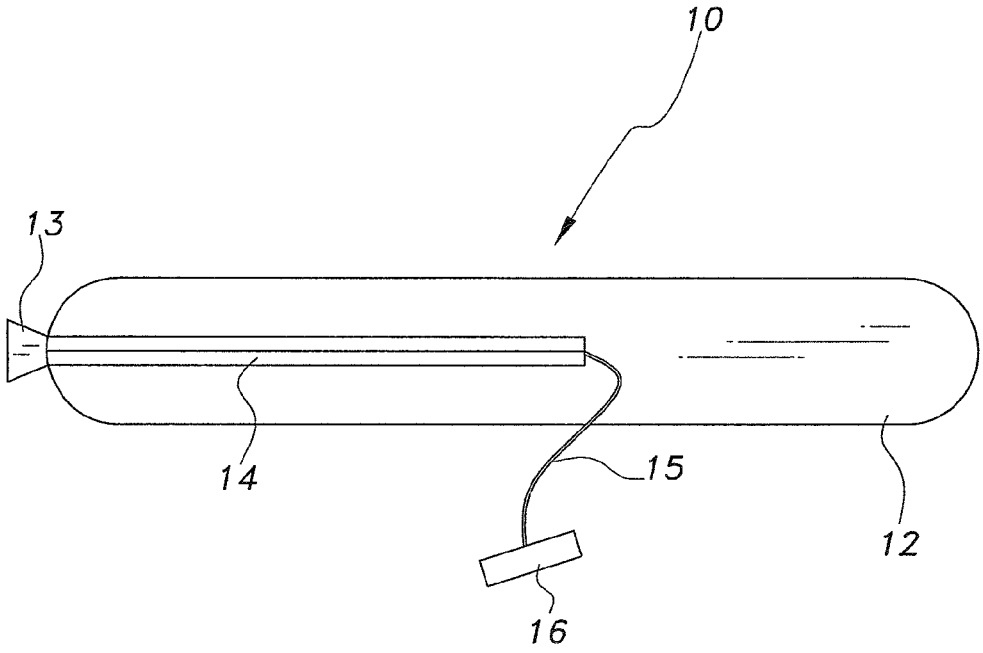
FIG. 3 is a bottom plan view of the removable dispensing cover of FIG. 1.

The removable dispensing cover for a tissue box, the removable dispensing cover being generally referred to by the reference number 10 in the Figures, provides an easy and convenient means of opening a fresh box of paper tissues of the type commonly referred to as face tissues with minimal chances of contamination. As best seen in FIGS. 1-4, the removable dispensing cover 10 is an elongated strip of material adapted for detachable mounting to a tissue box 11. The tissue box 11 may be provided as a relatively short, rectangular box, as shown, or in other various sizes and shapes, such as a square box, depending on the dimensions and arrangement of paper tissues T contained therein.

The removable dispensing cover 10 is a generally oblong strip 12 preferably constructed from the same material as the tissue box 11. Although other materials may be used, using the same material as the tissue box 11 reduces or minimizes manufacturing costs and increases production efficiency. The opposite ends of the oblong strip 12 may be rounded, as shown, or any other desired shape. To enable removal of the oblong strip 12 from the top of the tissue box 11, the top panel of the tissue box 11 is preferably perforated to form or outline the shape of the oblong strip 12 to permit a user to selectively tear the oblong strip 12 away from the box 11. The oblong strip 12 may also be a separate strip joined to the top panel by adhesive, adhesive strips, or the like.

A pull tab 13 extends from one end of the oblong strip 12. The pull tab 13 provides a handle for the user to grab onto in the process of tearing or removing the oblong strip 12 from the tissue box 11, which eases the process of opening the tissue box 11 for subsequent use. The pull tab 13 is preferably a square or trapezoidal strip of material attached to the end of the oblong strip 12. The preferred material of the pull tab 13 is nylon, but other materials, such as paper, cardboard, plastic, metal, composites, and the like, may also be used. The general shape may also be any shape amenable to grasping by the user.

An elongated length of dispensing string, thread, or wire 15 is attached to the bottom of the oblong strip 12 by an adhesive or other securing strip 14. The dispensing string 15 and the securing strip 14 preferably extend from a terminal end of the pull tab 13 at one end of the oblong strip 12 to about halfway along the length of the oblong strip 12. The length of the securing strip 14 may vary, so long as the securing strip 14 can maintain fixed attachment of the dispensing thread 15 onto the bottom of the oblong strip 12. The securing strip 14 is preferably an elongated strip of adhesive or adhesive tape. Other securing means, however, may also be used, such as fasteners, staples, and the like.

The dispensing thread 15 is longer than the length of the securing strip 14, and the remaining, unattached portion of the dispensing thread 15 is left free. A dispensing strip 16 is attached to a distal end of the free portion of the dispensing thread 15. The dispensing strip 16 is configured to be attached to the top sheet or sheets of paper tissue T contained in the tissue box 11. The dispensing strip 16 is preferably constructed from the same material as the securing strip 14, although the strength of the adhesive may be less. The dispensing strip 16 grasps the top tissue sheet T so that the top tissue sheet T is pulled as the dispensing thread 15 is pulled. The dispensing strip 16 may also be provided as a drop of deformable adhesive and the like.

Figure 4:
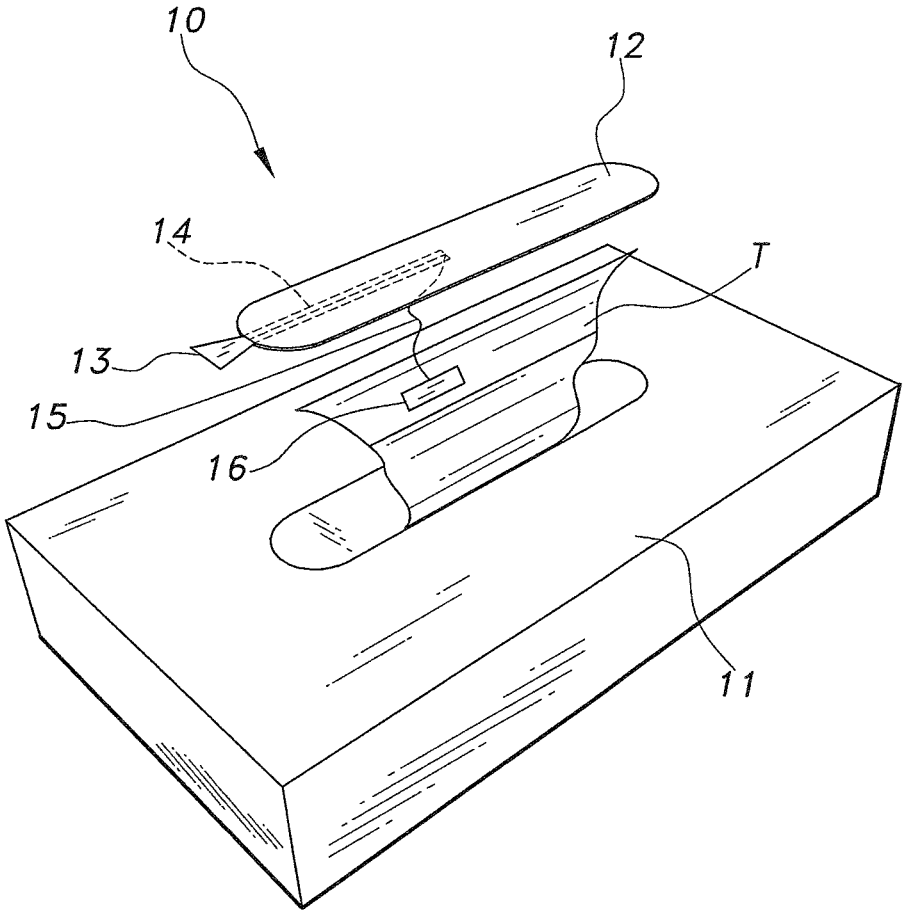
FIG. 4 is an environmental perspective view of the removable dispensing cover of FIG. 1, showing the removable cover fully removed from a tissue box and trailing a tissue sheet.

As shown in FIGS. 1 and 4, the user pulls the dispensing cover 10 via the pull tab 13 to open a fresh tissue box 11. The removal of the dispensing cover 10 from the tissue box 11 causes the attached dispensing thread 15 to become taut so that the attached dispensing strip 16 also pulls the top tissue sheet T at the same time. Thus, the process of opening the tissue box 11 also dispenses the tissue sheet T. This construction of the removable dispensing cover 10 eases the process of opening the tissue box 11 and using the contents therein, and also eliminates much of the potential transfer of germs that may be transmitted while manually opening the box 11 and removing the top sheet of tissue T.

It is to be understood that the present invention is not limited to the embodiments described above, but encompasses any and all embodiments within the scope of the following claims.

I claim:

1. A removable dispensing cover for a box of face tissues, comprising:

an oblong strip adapted for detachable mounting to a top of a face tissue box, the oblong strip having a longitudinal axis, a top surface and opposed ends;

a pull tab extending solely from one of the opposed ends of the oblong strip and adapted for selective grasping by a user and pulling the oblong strip away from the tissue box to open the same;

an elongated dispensing thread extending along the longitudinal axis and having a distal portion and a proximal portion thereof attached to the one of the opposed ends of the oblong strip contiguous to the pull tab, wherein an elongated securing strip attaches the proximal portion of the dispensing thread to the oblong strip; and a dispensing strip attached to the distal portion of the dispensing thread, the dispensing strip adapted to be attached to a top sheet of face tissue in the tissue box;

whereby selectively pulling of the oblong strip away from the tissue box with the pull tab is adapted to pull the top sheet of face tissue from the tissue box.

2. The removable dispensing cover for tissue boxes according to claim 1, wherein said elongated pull tab is made of nylon.

3. The removable dispensing cover for tissue boxes according to claim 1, wherein said securing strip comprises a length of adhesive tape.

4. The removable dispensing cover for tissue boxes according to claim 1, wherein said dispensing strip comprises a length of adhesive tape.

5. A removable dispensing cover in combination with a tissue box, comprising:

the tissue box having a top wall and an access opening defined in the top wall for pulling out tissues;

an oblong strip detachably mounted to the top wall of the tissue box, the oblong strip having a longitudinal axis, a top surface, and opposed ends, the oblong strip covering the access opening;

a pull tab extending solely from one of the opposed ends of the oblong strip, the pull tab being attached to the oblong strip for selective grasping by a user and for pulling the oblong strip away from the tissue box to uncover the access opening;

an elongated dispensing thread extending along the longitudinal axis and having a distal portion and a proximal portion thereof attached to the one opposed end of the oblong strip contiguous to the pull tab, wherein an elongated securing strip attaches the proximal portion of the dispensing thread to the oblong strip; and a dispensing strip attached to the distal portion of the dispensing thread, the dispensing strip being attached to a top sheet of face tissue contained atop a stack of face tissues in the tissue box, whereby selectively pulling of the oblong strip away from the tissue box with the pull tab also pulls the top sheet of face tissue from the tissue box.

6. The removable dispensing cover in combination with the tissue box according to claim 5, wherein said pull tab is made of nylon.

7. The removable dispensing cover in combination with the tissue box according to claim 5, wherein said elongated securing strip comprises a length of adhesive tape.

8. The removable dispensing cover in combination with the tissue box according to claim 5, wherein said dispensing strip comprises a length of adhesive tape.

* * * * *